United States Patent [19]

Casilio

[11] Patent Number: 4,790,580

[45] Date of Patent: Dec. 13, 1988

[54] LOCKING SUPPORT FOR VERTICALLY TRANSLATABLE ARTICLE

[75] Inventor: Leonello Casilio, Webster, N.Y.

[73] Assignee: Xerox Corporation, Stamford, Conn.

[21] Appl. No.: 41,957

[22] Filed: Apr. 24, 1987

[51] Int. Cl.[4] ..... E05C 17/30

[52] U.S. Cl. ..... 292/262; 292/338; 292/DIG. 4

[58] Field of Search ..... 292/DIG. 4, 262, 270, 292/278, 338

[56] References Cited

U.S. PATENT DOCUMENTS

| | | | |
|---|---|---|---|
| 2,229,513 | 1/1941 | Lustig | 217/60 |
| 2,996,210 | 8/1961 | Thomas | 217/60 |
| 4,042,266 | 8/1977 | Anderberg et al. | 292/DIG. 4 X |
| 4,078,779 | 3/1978 | Mölders | 292/338 X |
| 4,331,355 | 5/1982 | Okuno | 292/DIG. 4 X |

FOREIGN PATENT DOCUMENTS

| | | | |
|---|---|---|---|
| 331753 | 7/1930 | United Kingdom | 217/60 |

*Primary Examiner*—Richard E. Moore

[57] ABSTRACT

A latching mechanism provides a locking support for an article which periodically requires to be moved from a rest position to a stable elevated position. The latching mechanism comprises an assembly attached to the article and movable therewith, the assembly containing a guide mechanism which cooperates with a cam pawl device mounted on a fixed assembly. The cam/guide mechanism interaction provides for a 180° cam rotation driving a sequence of article movements from a rest to elevated/locked to rest position.

5 Claims, 3 Drawing Sheets

LOCKING SUPPORT FOR VERTICALLY TRANSLATABLE ARTICLE

This invention relates to a support assembly adapted to provide a fixed support to articles which must be periodically raised from an at rest position to an elevated position.

There are various prior art mechanisms in which a catch support is automatically engaged when the supported article is moved beyond a normal rest position. One example is the support struts employed to permit an automobile trunk or tail gate window to be raised from a closed to an open position and automatically held in the open position.

U.S. Pat. No. 2,229,513 to Lusting teaches a telescoping lid support for a liftable hinged closure such as an automobile trunk door. The lid support comprises two telescoping arms. A rotatable pawl is attached to one arm, and is slidably extensible and retractable with a second arm. Extending the telescoping arms apart causes the pawl to rotate to a position which locks the arms in position. Extending the arms again, to an extreme position, further rotates the pawl and allows the pawl to slide freely so that the arms may be closed upon each other.

U.S. Pat. No. 2,996,210 to Thomas discloses a support strut for holding a closure such as an automobile tail gate in an open position. A pair of telescoping support members are provided with a rotatable cam-type latch mechanism. The latch is provided to automatically hold the support members in an extended position upon movement of the closure to an open position. Subsequently extending the closure slightly beyond the open position operates the latch to permit movement of the supports to a closed position.

As further examples of prior art catch mechanisms, U.S. Pat. No. 4,042,266 to Anderberg et al. discloses an extensible safety latch means for a pivotable window. A first latch assembly is provided as a key-operable, spring-loaded stop boss (12). A second latch assembly includes a sequencing latch (22) joined to an inner latch bar by a pivot. The second latch means is provided to secure a window in a stationary open position for cleaning.

British Pat. No. 331,753 to Greenman discloses an automatically engaging stay or strut for hinged or folding articles. A rotatable pivot pin is provided in a slot. Upon sliding the pivot pin to the end of the slot, it contacts a small flange which rotates the pin about $\frac{1}{8}$ of a revolution. The pin then recedes back into the slot and a corner of the pin comes against an upper wall which turns the pin another $\frac{1}{8}$ of a revolution and prevents it from passing further along the slot, thus locking it in place. To unlock the pin, it is moved to the end of the slot again, where it contacts the small flange and is rotated a further $\frac{1}{8}$ of a revolution. Letting the pin recede into the slot, the pin is turned a final $\frac{1}{8}$ of a revolution by the upper wall which allows it to pass freely back along its path.

These prior art devices relate to the support of pivotably raised or hinged members. The mechanisms are similar in relying on rotatable pawls or cam members becoming engaged in a slot formed within a support guide member. The present invention is directed towards a locking support mechanism for articles which are translated vertically to new rest positions. A rotatable pawl is caused to change orientation so that the article, in its elevated rest position, is stably supported by both sides of the pawl mechanism. More particularly, the invention is related to a locking support for a vertically translatable article comprising:

a first assembly fixedly mounted in perpendicular orientation with said article, said assembly including a piston cylinder arrangement with one end of the piston rod secured to the article;

a second assembly secured to the translatable article and adapted to be movable therewith, said second assembly including a guideway member extending in a generally perpendicular downward direction from said article and having a longitudinally extending slot therethrough, said guideway member also including a first and second guide bar positioned on opposite sides of said slot and further including a raised lug at the bottom terminus of said slot; and a star cam rotatably mounted on said first assembly on an axis transverse thereto and extending through said slot, said cam having two sets of pawls in diametrically opposed relationship;

said cam rotation being normally constrained by said guide bars;

whereby, when said article is raised to a new position, said cam pawls interact with the lower edges of the guide bars and the lug to establish a locked position of the cam sufficient to enable the article to be supported by one set of opposed pawls.

Referring now to the drawings.

Figure 3A:
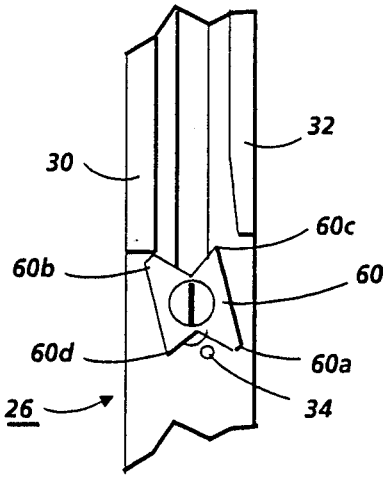
Figure 3B:
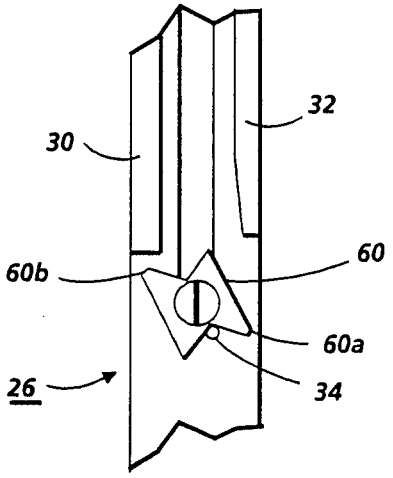

FIGS. 3*a* and 3*b* show the pawl orientation during the vertically upward movement of the supported article.

Figure 4A:
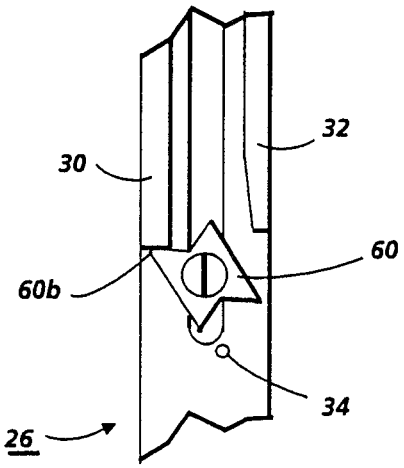
Figure 4B:
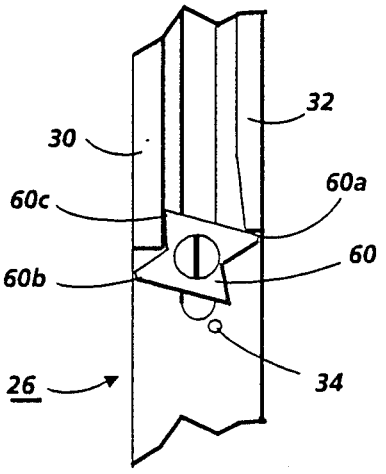

FIGS. 4*a* and 4*b* show the pawl's orientation when the supported article is lowered to its elevated catch position.

FIGS. 5*a*, 5*b*, 5*c*, 5*d* show the pawl orientation during the release of the supported article and its return to the normal rest position.

Figure 1:
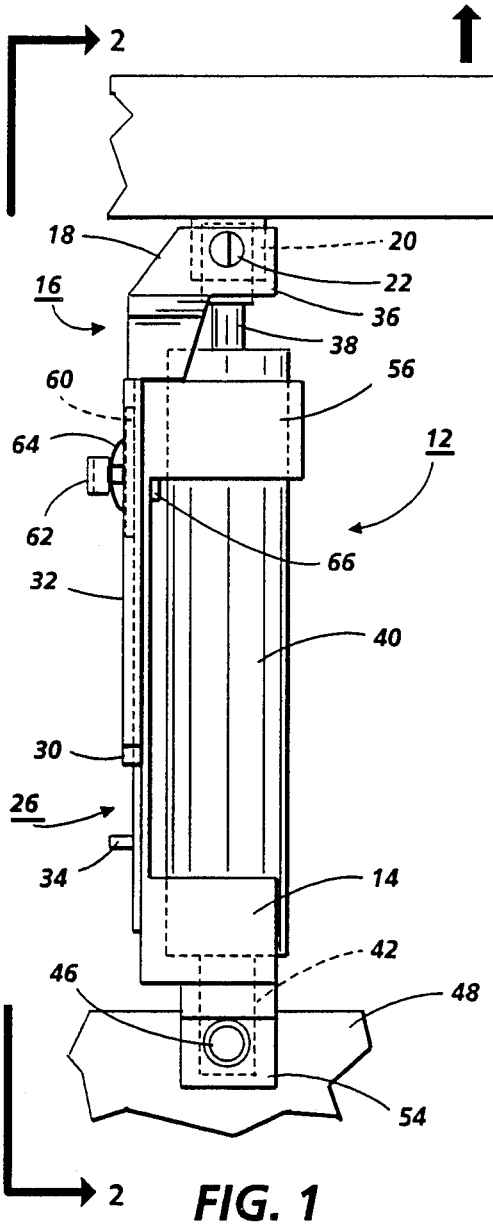
FIG. 1 shows a side view of the locking support assembly of the present invention.
Figure 2:
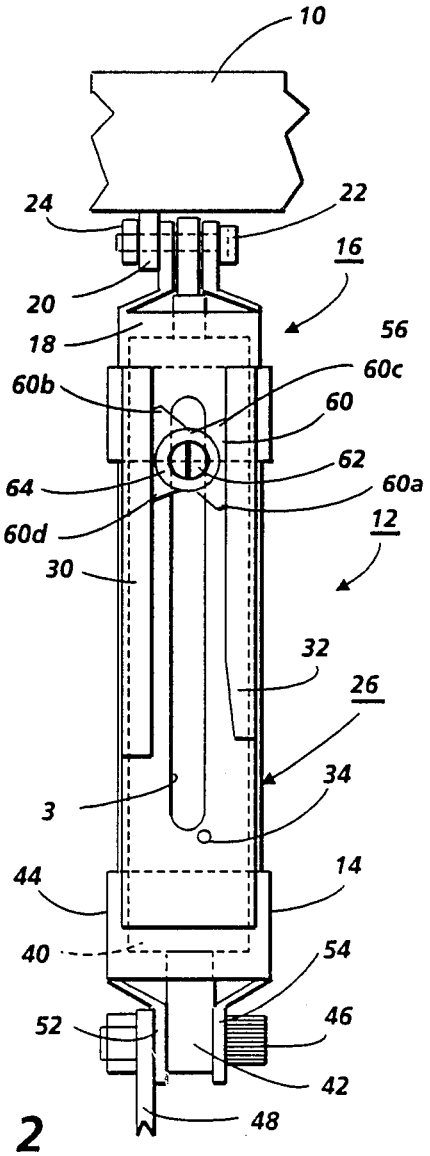
FIG. 2 shows a front view of the assembly locating the sliding pawl mechanism.

Referring now to FIGS. 1 and 2, there is shown a preferred embodiment of the locking support assembly of the present invention. A relatively heavy article 10, must be periodically moved upward and secured in a raised position. As one example, article 10 can be a paper transport in a copier machine which must be periodically raised and maintained in an elevated position in order to clear paper jams occurring beneath the transport. It is desirable that the article (transport) be lifted by an operator and secured, with one hand with the second hand free to perform another related task. This goal is achieved by the operation of locking support assembly 12. Assembly 12 consists of two mechanisms, a fixed support assembly 14 and a movable assembly 16, having one end firmly secured to the article 10. Movable assembly 16 comprises an upper bracket member 18 which is secured to mounting flange 20, flange 20 being an integral part of article 10. Bracket member 18 is secured to flange 20 by means of screw 22 and hex nut 24.

Integrally connected to bracket member 18 is slotted guideway member 26. As shown in FIG. 2, guideway 26 has a generally rectangular configuration with raised guide bars 30 and 32 at the edges thereof. Bar 30 is generally rectangular, bar 32 is also generally rectangular, but differs from bar 30 in being slightly shorter and having a chamfered lower left edge. Both bars have slight recesses on their interior opposing edges. Guideway 26 has an elongated slot 32 centered along its vertical length. Beneath the bottom of slot 32, slightly right of center is raised lug 34. Affixed to the bracket member 18 by means of screw 22 and nut 24 is a piston mounting head 36, integrally attached to piston 38.

Referring again to FIGS. 1 and 2, fixed support assembly 14 comprises a cylindrical housing 40 having a bottom mounting flange 42, having a threaded aperture therethrough. The housing is attached to bracket member 44 by screw 46. Screw 46 fixedly secures member 44 to a stationary member 48. Bracket member 44 has a lower portion having two flanges 52, 54 bent inward to contact both sides of cylinder mounting flange 42. A central generally rectangular area gives way to an idler member 56 which encloses housing 40. Connected just below collar member 56 is a four-pointed star cam 60. Cam 60 has two pawls 60*a*, 60*b* of equal size and two pawls 60*c* and 60*d* equal but smaller than 60*a*, 60*b*. Cam 60 is connected to the rectangular portion of member 44 by screw 62, nut 64 and washer 66 so as to permit the cam to rotate freely. Cam 60 is mounted within slot 32 of guiding member 26 and is adapted to rotatingly slide along the surface of guideway 26 and its edges held within the recesses of bars 30 and 32 during vertical displacement of the article, as will be described in further detail below. Fixed assembly 14 is therefore seen to provide a stable and secure mounting for securing the position of the cylinder housing and cam 60, as well as the fundamental object of providing support to the article 10 in both its normal rest position and its raised catch position.

A sequence of operation will now be described in connection with FIGS. 3–5. These figures depict the movement of guideway 26 and the interaction with cam 60 and raised lug 34 as article 10 is raised to the limit of its upward motion, lowered to a catch (lock) position and then restored (lowered) to its normal rest position.

Turning now to FIG. 1 and 3*a*, it is assumed that a paper jam has occurred and transport 10 must be raised and locked into an elevated position to remove the paper. Although only the cam 60 and the lower portion of the guideway are shown in FIGS. 3 and 5, it is understood that drawer 10 will be moved vertically by the actions described below.

The operator grasps one end of the transport 10 and urges the transport in an upward direction. As the transport is moved, movable assembly 16 is translated upward, causing piston rod 38 to be withdrawn from housing 40. Bars 30 and 32 of slide member 26 move past cam 60 which maintains the same orientation shown in FIG. 2 until cam pawl 60*a* contacts raised lug 34 (FIG. 3*a*). As the transport is raised further, cam 60 is caused to rotate in a counterclockwise direction, causing pawl 60*b* rotating past the lower left edge of bar 30. FIG. 3*b* shows the position of cam 60 at the maximum elevated position of transport 10. The operator, still grasping the transport, allows it to descend by gravitational force until the cam undergoes a further rotation shown in FIG. 4*a*. FIG. 4*a* shows that cam pawl 60*b* is now in the path of bar 30 and as the transport is lowered, bar 30 contacts pawl 60*b*, forcing cam 60 to rotate counterclockwise until it assumes the catch or locked position shown in FIG. 4*b*. At this point, the lower edges of bar 30 and bar 32 abut pawl 60*a*, 60*b* and 60*c* establishing an equilibrium of forces between the pawls. The weight of transport 10, prevents the cam from further rotation. At this point the operator can release the drawer as its own weight will ensure a stable work position.

Figure 5A:
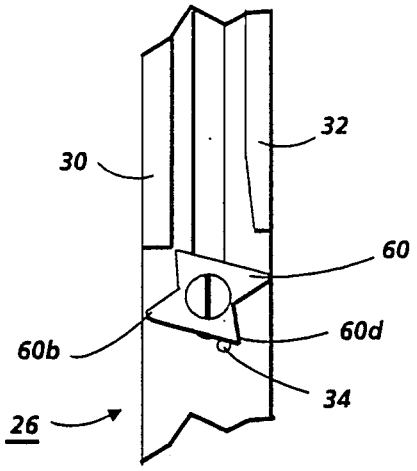
Figure 5B:
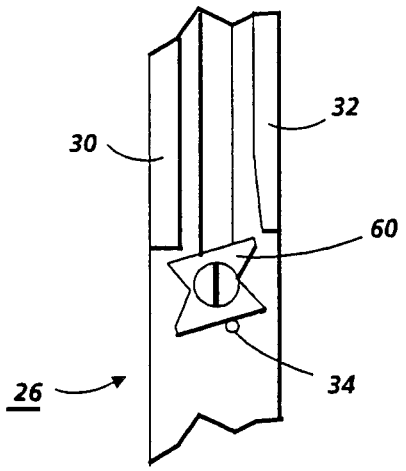
Figure 6A:
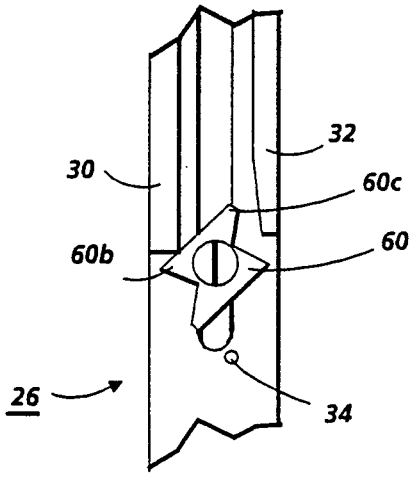
Figure 6B:
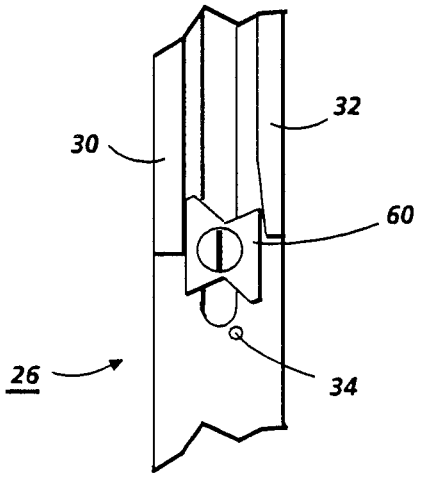

When the drawer is to be restored to its normal rest position, the operator will raise the drawer upward until pawl 60*d* is contacted by lug 34 (FIG. 5*a*). As the sliding member 26 continues to be drawn upward with the motion of drawer 10, the cam is rotated clockwise to the position shown in FIG. 5*b* which represents the maximum raised position of the drawer. As the drawer is lowered, the lower edge of bar 30 meets pawl 60*b* as shown in FIG. 5*c*, forcing the cam 60 to continue a clockwise rotation. Pawl 60*c* is seen to rotate so as to just clear the chamfered edge of bar 32. With the continued lowering of the drawer both sides of the cam are again aligned within the guideway formed between bars 30 and 32. The drawer is then lowered back to the rest position of FIG. 1. It is seen that the cam 60 undergoes a 180° rotation during a complete raise/lower cycle. It is understood that through all of these positions, the transport travel is damped by the action of the operation of the piston/cylinder assembly.

There has therefore been described an exemplary embodiment of a latching device which enables safe and convenient raising and locking of an article along a vertical path.

While the invention has been described with reference to the structure disclosed, it is not confined to the details set forth, but is intended to cover such modifications or changes as may come within the scope of the following claims:

What is claimed is:

1. A locking support for an article adapted to be moved from a first to a second position comprising:

a first assembly including a piston cylinder arrangement with one end of the piston rod secured to the article;

a second assembly secured to the article and adapted to be movable therewith, said second assembly including a guideway member extending in a generally perpendicular direction to the article and having a longitudinally extending slot therethrough, said guideway member also including a first and second guide bar positioned on opposite sides of said slot and further including a raised lug at the bottom terminus of said slot; and a star cam rotatably mounted on said first assembly on an axis transverse thereto and extending through said slot, said cam having two sets of pawls in diametrically opposed relationship;

said cam rotation being normally constrained by said guide bars;

whereby, when the article is moved to a new position, said cam pawls interact with the lower edges of the guide bars and the lug to establish a locked position of the cam sufficient to enable the article to be supported by one set of opposed pawls.

2. The locking support of claim 1 wherein, when the article is moved to a new position, said cam rotates through 90°.

3. The locking support of claim 1 wherein one of the bottom edges of said guide bars terminates at a point higher than the other.

4. The locking support of claim 3 wherein the article is restored to a normal rest position by raising and then lowering the article, thereby causing the cam to cooperate with said guide bar edge and lug to cause an additional 90° of rotation.

5. A locking support for an article adapted to be moved from a first to a second position, said support comprising:

a first movable assembly attached to the article and a second fixed assembly, said first assembly including:

a generally rectangular assembly including a guideway member extending in a perpendicular orientation to said article, said guideway member including an elongated slot cut therethrough, a pair of guide bars positioned on opposite sides of said slot, the bottom edges of said bars terminating at a point about a raised lug positioned at the lower end of said slot;

said first assembly further including a piston rod extending in a direction generally parallel to said guideway member and means to fixedly secure said guideway member and piston rod to the article;

said fixed assembly including a cylinder housing which cooperates with said piston rod to form a piston/cylinder damping assembly, a mounting member forming a support for said housing, said mounting member having a rotatable star cam connected to an upper surface thereof, said star cam motion adapted to be restrained within the guideway formed by said slide bars until such time as the article is vertically translated;

means to move said guideway member, from a first to a second position whereby said lug member engages one of the pawls of the star cam, imposing a rotational motion to the cam, the cam interacting with the bottom edges of said guide bars to assume a locked position.

* * * * *